US006024651A

United States Patent [19]

Cheng

[11] Patent Number: 6,024,651

[45] **Date of Patent: *Feb. 15, 2000**

[54] GOLF CLUB SHAFT HAVING CONTOURED GRIP SECTION AND KICK SECTION

[75] Inventor: Michael H. L. Cheng, Simi Valley, Calif.

[73] Assignee: Harrison Sports, Inc., Pacoima, Calif.

[ * ] Notice: This patent is subject to a terminal disclaimer.

[21] Appl. No.: 09/005,559

[22] Filed: Jan. 12, 1998

Related U.S. Application Data

[63] Continuation-in-part of application No. 08/953,124, Oct. 17, 1997, Pat. No. 5,957,783.

[51] Int. Cl.[7] ..... A63B 53/14

[52] U.S. Cl. ..... 473/300; 473/316; 473/323

[58] Field of Search ..... 473/315, 316, 473/317, 318, 319, 320, 321, 322, 323, 201, 202, 203, 549, 568, 538, 300, 303; D21/756, 759

[56] References Cited

U.S. PATENT DOCUMENTS

| | | | |
|---|---|---|---|
| Re. 33,735 | 11/1991 | Rumble et al. . | |
| 1,232,816 | 7/1917 | Lard . | |
| 1,418,038 | 5/1922 | Tousey | 473/318 |
| 2,031,161 | 2/1936 | Hamel . | |
| 2,086,275 | 7/1937 | Lemmon . | |
| 2,117,129 | 5/1938 | Young | 473/316 |
| 2,130,395 | 9/1938 | Lard . | |
| 2,150,737 | 3/1939 | Chittick . | |
| 2,153,880 | 4/1939 | Barnhart . | |
| 2,220,852 | 11/1940 | Scott . | |
| 2,250,428 | 7/1941 | Vickery | 473/323 |
| 3,083,969 | 4/1963 | Bills . | |
| 3,614,101 | 10/1971 | Hunter | 473/301 |
| 3,809,403 | 5/1974 | Hunter | 473/316 |
| 4,169,595 | 10/1979 | Kaugars . | |
| 4,205,845 | 6/1980 | Kanne . | |
| 4,288,075 | 9/1981 | Kaugars et al. . | |
| 4,319,750 | 3/1982 | Roy . | |
| 4,330,126 | 5/1982 | Rumble . | |
| 4,431,187 | 2/1984 | Rumble et al. . | |
| 4,455,022 | 6/1984 | Wright . | |
| 4,470,600 | 9/1984 | Parente et al. . | |
| 4,555,112 | 11/1985 | Masghati . | |
| 4,591,157 | 5/1986 | Parente et al. . | |
| 5,018,735 | 5/1991 | Meredith . | |
| 5,251,896 | 10/1993 | Gerlach . | |
| 5,294,119 | 3/1994 | Vincent et al. . | |
| 5,316,299 | 5/1994 | Feche et al. . | |
| 5,362,046 | 11/1994 | Sims . | |
| 5,496,028 | 3/1996 | Chien . | |
| 5,551,691 | 9/1996 | Harada . | |
| 5,599,242 | 2/1997 | Solviche . | |
| 5,634,860 | 6/1997 | McIntosh . | |
| 5,665,010 | 9/1997 | Mori | 473/318 |
| 5,695,408 | 12/1997 | DeLaCruz et al. . | |
| 5,711,728 | 1/1998 | Marcelo . | |
| 5,716,291 | 2/1998 | Morell . | |
| 5,735,752 | 4/1998 | Antonious | 473/318 |
| 5,735,753 | 4/1998 | Hoffmeyer | 473/318 |
| 5,755,826 | 5/1998 | Beach | 473/320 |
| 5,820,480 | 10/1998 | Cheng | 473/319 |

FOREIGN PATENT DOCUMENTS

| | | | |
|---|---|---|---|
| 173914 | 7/1921 | United Kingdom . | |
| 389353 | 3/1933 | United Kingdom | 273/80 B |

*Primary Examiner*—Sebastiano Passaniti
*Attorney, Agent, or Firm*—Henricks, Slavin & Holmes LLP

[57] ABSTRACT

A golf club shaft having a main body section and a grip section associated with the proximal end of the main body section. The grip section includes a top hand portion, a bottom hand portion and a substantially cylindrical bottom thumb portion. A kick section is provided between the grip section and main body section.

23 Claims, 8 Drawing Sheets

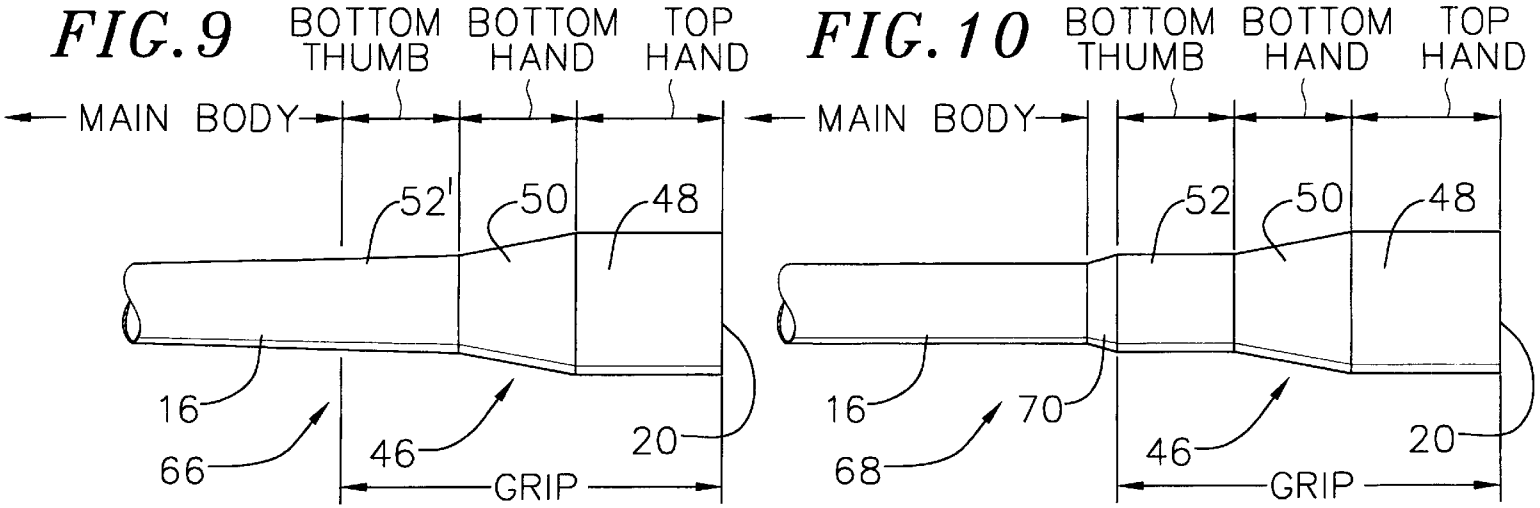
FIG. 9
FIG. 10
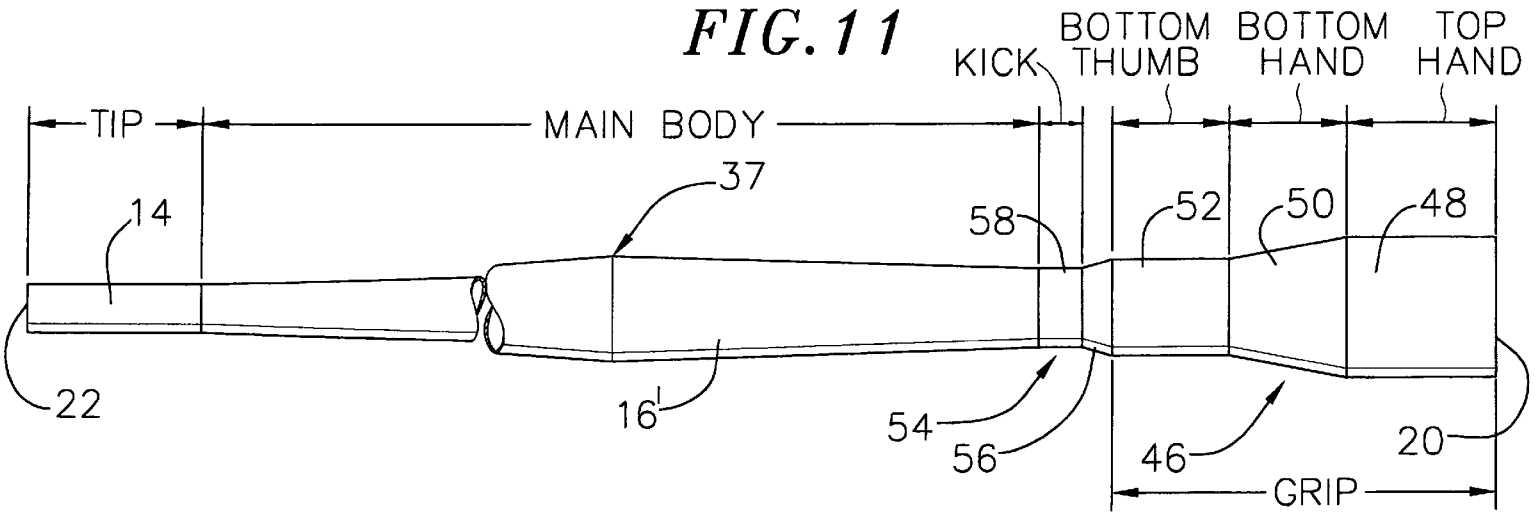
FIG. 11

GOLF CLUB SHAFT HAVING CONTOURED GRIP SECTION AND KICK SECTION

CROSS-REFERENCE TO RELATED APPLICATIONS

This application is a continuation-in-part of U.S. application Ser. No. 08/953,124, filed Oct. 17, 1997 now U.S. Pat. No. 5,957,783.

BACKGROUND OF THE INVENTION

1. Field of Invention

The present invention relates generally to golf clubs and, more particularly, to golf club shafts.

2. Description of the Related Art

Over the years, many substitutes have been introduced for the hard wood shafts originally used in golf club drivers and irons. Early substitute materials included stainless steel and aluminum. More recently, carbon fiber reinforced resin shafts have become popular. Fiber reinforced resin shafts are typically hollow and consist of a shaft wall formed around a tapered mandrel. The mandrel typically consists of three mandrel sections. The first mandrel section forms the tip section of the shaft, the second mandrel section forms the main body section, and the third mandrel section forms the grip section. Shafts formed in this manner typically have a constant taper from the tip/main body intersection to the main body/grip intersection. Additionally, a grip is often placed over the grip section to facilitate the golfer's grasp of the club.

As shown in FIG. 1A, the grip section of a conventional shaft is often substantially cylindrical over its entire length. Here, the grip (shown in dotted lines) is tapered in an attempt to make the grip portion of the golf club, i.e. the portion which consists of the grip and the grip section of the shaft, conform to the shape of the golfer's hands. Referring to FIG. 1B, other conventional golf club shafts, often referred to as "large butt" shafts, include a grip section which tapers from one end to the other. Here, the thickness of the grip (shown in dotted lines) is substantially uniform over its entire length. As such, from the standpoint of the golfer's hands, the respective grip portions of the clubs shown in FIGS. 1A and 1B are essentially the same, i.e. there is a straight taper from one end of the grip portion to the other. The slope of the straight taper is typically such that the outer diameter of the grip portion decreases at a rate of 0.0285 inch/inch of shaft length.

The inventor herein has determined that there are a number of disadvantages associated with the conventional golf club shafts shown in FIGS. 1A and 1B. For example, the straight taper does not conform well to the contour of the golfer's hands. This is especially true with respect to the bottom hand, which is the right hand for right-handed golfers and the left hand for left-handed golfers. Additionally, there are many instances where a golfer will want to "choke up" on a club, i.e. move his or her hands to a lower position on the shaft, to decrease the distance the ball will travel. With a conventional club, this will change the golfer's top hand grip on the club, as well as the more important bottom hand and bottom thumb grip on the club, because the outer diameter (OD) of the grip portion of the club decreases from one end to the other.

Turning to FIG. 1C, another type of conventional shaft includes a main body section with a relatively large OD, a conventionally sized grip section and a short connecting section therebetween. Such shafts are often referred to as "wide body" shafts. Such a shaft is disclosed in U.S. Pat. No. 5,316,299 to Feche et al. The primary benefit of a wide body shaft is that, for a given shaft wall thickness, the wide body shaft will be stiffer than other conventional shafts. The stiffest portion of certain wide body shafts is the portion of the main body section which abuts the connecting section because this is where the OD of the main body section is the greatest. The inventor herein has determined that this can be undesirable for some golfers.

SUMMARY OF THE INVENTION

Accordingly, the general object of the present invention is to provide a golf club shaft which avoids, for practical purposes, the aforementioned problems. In particular, one object of the present invention is to provide a golf club shaft which conforms more closely to a golfer's hands than a conventional shaft. Another object of the present invention is to provide a "wide body" shaft with greater flexibility near the grip section than conventional "wide body" shafts.

In order to accomplish some of these and other objectives, a golf club shaft in accordance with one embodiment of the present invention has a main body section and a grip section associated with the proximal end of the main body section. The grip section includes a top hand portion, a bottom hand portion, and a substantially cylindrical bottom thumb portion. One of the top and bottom hand portions may be tapered, while the other is substantially cylindrical. Such a shaft provides a number of advantages over conventional shafts. For example, a golf club incorporating the present shaft will have a grip portion with a contour that is closer to the natural contour of the golfer's hands than clubs employing conventional shafts and/or conventional shaft/grip arrangements. Because the OD of the generally cylindrical bottom thumb portion is substantially constant, a golfer can choke up on the club without altering the golfer's important bottom thumb grip on the shaft. Moreover, the grip section can be configured such that the bottom hand portion is also substantially cylindrical, thereby further reducing any alteration of the golfer's grip as he or she chokes up on the shaft.

In order to accomplish some of these and other objectives, a golf club shaft in accordance with another embodiment of the present invention includes a grip section, a main body section, and a kick section between the grip section to the main body section. The kick section is more flexible than the adjacent portions of the grip and main body sections. As a result, the flexibility of the shaft is increased in the area adjacent to the grip section, as compared to conventional shafts. The stiffest portion of certain embodiments of the present shaft, which is typically the point of maximum OD in the main body section, is also farther from the grip section than conventional shafts. Such features are of particular benefit in "wide body" shafts which can be too stiff near the grip section for some golfers.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiments of the invention will be made with reference to the accompanying drawings.

FIG. 9 is a partial side view of a golf club shaft in accordance with yet another preferred embodiment of the present invention.

FIG. 10 is a partial side view of a golf club shaft in accordance with another preferred embodiment of the present invention.

FIG. 11 is a side view of a golf club shaft in accordance with still another preferred embodiment of the present invention.

DETAILED DESCRIPTION OF THE PREFERRED EMBODIMENTS

Figure 1A:
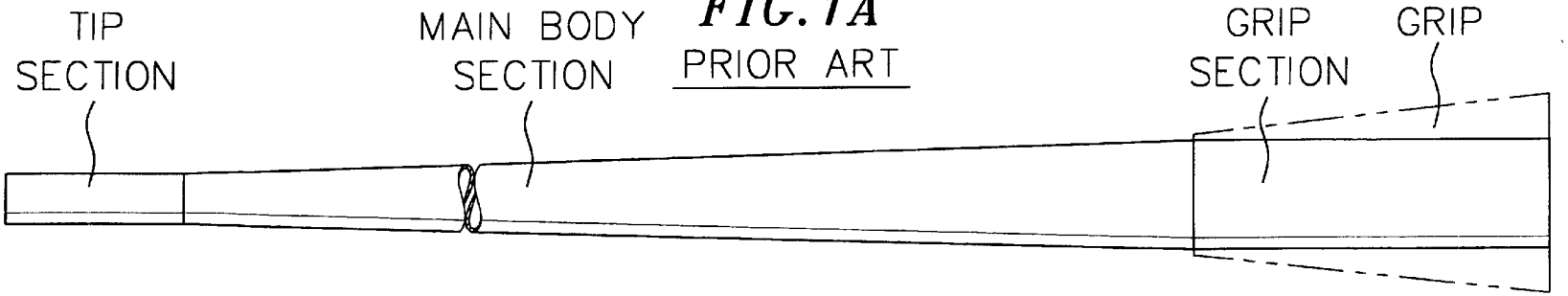
FIG. 1A PRIOR ART
FIG. 1A is a side view of a conventional shaft and grip arrangement.

The following is a detailed description of the best presently known mode of carrying out the invention. This description is not to be taken in a limiting sense, but is made merely for the purpose of illustrating the general principles of the invention. The scope of the invention is defined by the appended claims. Additionally, the exemplary golf club shafts discussed herein are described in terms of the golfer's top and bottom hands. For a right-handed golfer, the right hand is typically the bottom hand, while the left hand is typically the bottom hand for a left-handed golfer.

As illustrated for example in FIG. 2, a golf club shaft 10 in accordance with a preferred embodiment of the present invention includes a grip section 12, a tip section 14, a main body section 16, and a kick section 18 (discussed below) between the main body section and the grip section. The proximal end of the grip section 12 defines the butt end 20 of the shaft, while the distal end of the tip section 14 defines the tip end 22. The grip section 12 includes a frusto-conically shaped tapered top hand portion 24 and a generally cylindrical bottom hand/bottom thumb portion 26. As used herein, a tapered shaft portion is a portion having an outer surface which is sloped relative to the longitudinal axis of the shaft. The OD of the tapered top hand portion 24 is greater than the OD bottom hand/bottom thumb portion 26, except at the intersection between the two, where the two portions have a common OD. Preferably, a grip with a substantially uniform thickness is placed over the grip section 12. As a result, the grip portion of a golf club incorporating the exemplary shaft shown in FIG. 2, i.e. the combined grip and grip section of the shaft, will have a contour that is closer to the natural contour of the golfer's hands than clubs employing conventional shafts and/or conventional shaft/grip arrangements. Moreover, because the OD of the generally cylindrical bottom hand/bottom thumb portion 26 is substantially constant, a golfer can choke up on the club without altering the golfer's bottom hand and bottom thumb grip on the shaft.

The kick section 18 of the exemplary shaft 10 is the intersection point 32 between a frusto-conically shaped proximal connecting portion 28 and a frusto-conically shaped distal connecting portion 30. In other words, in the exemplary embodiment shown in FIG. 2, the kick section is a point with an OD that is less than the OD of the distal portion of the grip section 12 and also less than the largest OD of the main body section 16. As a result, the kick section 18 increases the flexibility of the shaft in the area of the grip section 12. Also, the kick section 18, in combination with the connecting portions 28 and 30, moves the stiffest portion of the main body section (the point of maximum OD) away from the grip section.

Figure 12A:
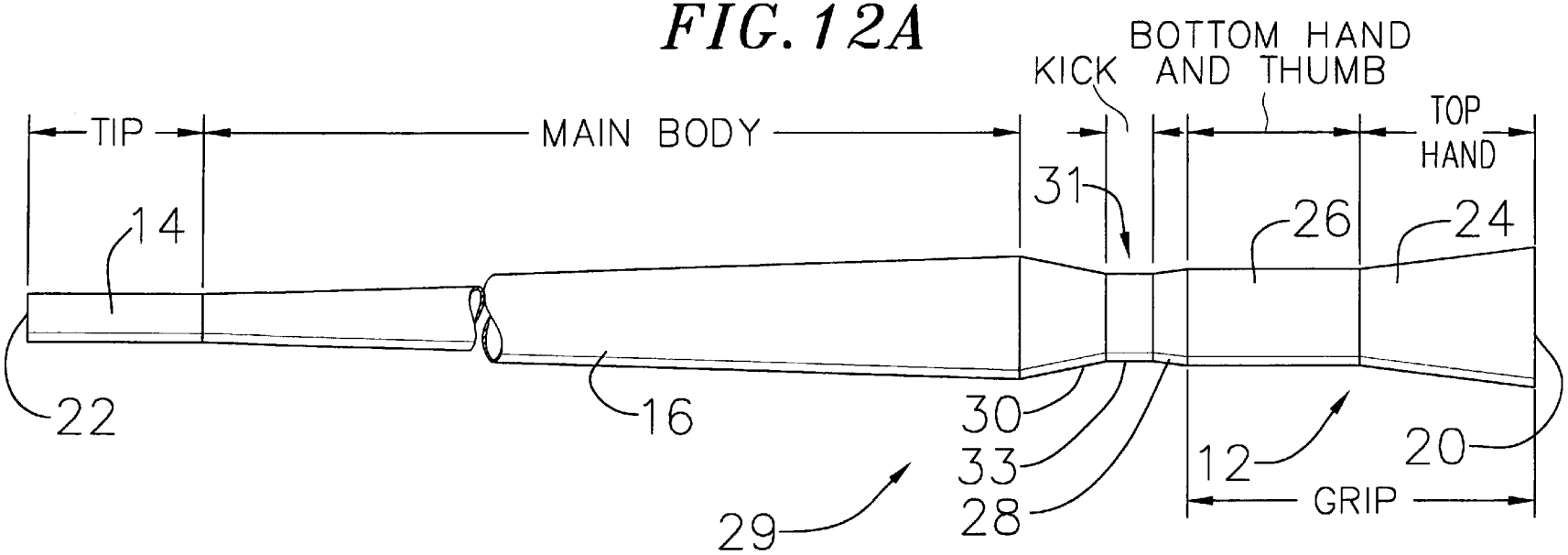
FIG. 12A is a side view of a golf club shaft in accordance with yet another preferred embodiment of the present invention.
Figure 14:
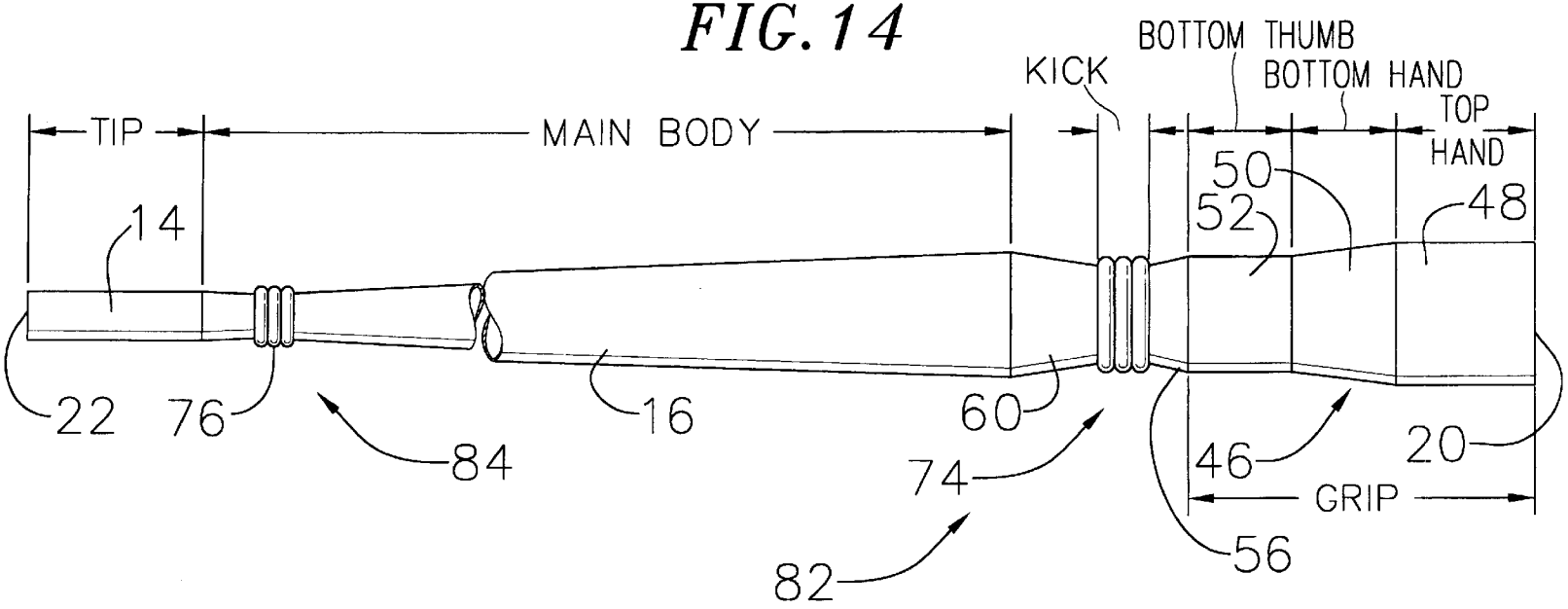
FIG. 14 is a side view of a golf club shaft in accordance with yet another preferred embodiment of the present invention.

In order to further increase the flexibility of the shaft, and as illustrated for example in FIG. 12A, the length of the kick section may be increased. More specifically, exemplary shaft 29 includes a kick section 31 which is formed by an elongate substantially cylindrical section 33. The kick section is connected to the grip section 12 and the main body section 16 by the frusto-conically shaped connecting portions 28 and 30. Like the exemplary kick section 18 illustrated in FIG. 2, exemplary kick section 31 creates an area of reduced OD near the grip section. The kick section 31 defines an OD that is less than the OD of the distal portion of the grip section 12 and that is also less than the largest OD of the main body section 16. This area is more flexible than the grip section and the proximal portion of the main body section. The kick section 31 shown in FIG. 14 is also longer (and, therefore, more flexible given the same OD) than the kick section 18 shown in FIG. 2.

Figure 12B:
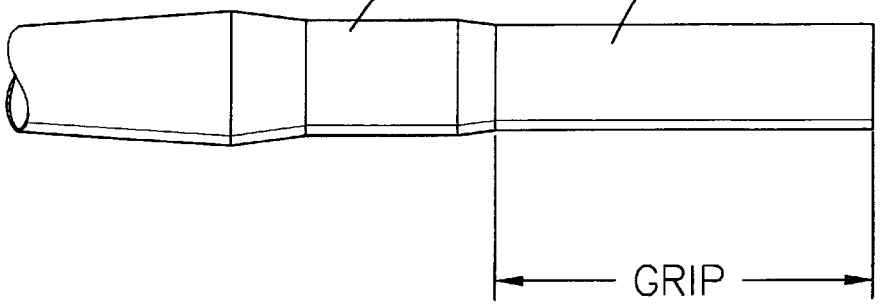
FIG. 12B is a partial side view of a golf club shaft in accordance with still another preferred embodiment of the present invention.

Alternatively, as shown by way of example in FIG. 12B, an elongate cylindrical section 41 having an OD that is larger than the distal end OD of the grip section 43, may be employed. Such a section will, of course, increase the stiffness of the shaft. In other embodiments, the OD of the cylindrical section 41 may be smaller than the smallest OD of the grip section.

Figure 1B:
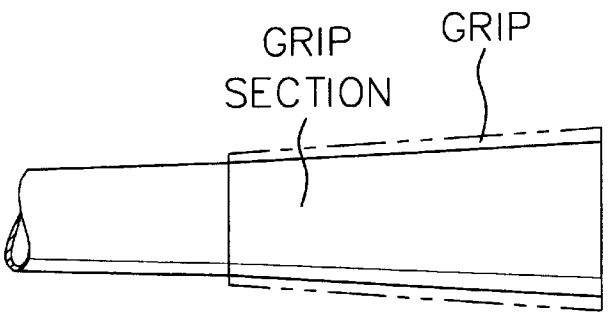
FIG. 1B PRIOR ART
FIG. 1B is a side view of another conventional shaft and grip arrangement.
Figure 1C:
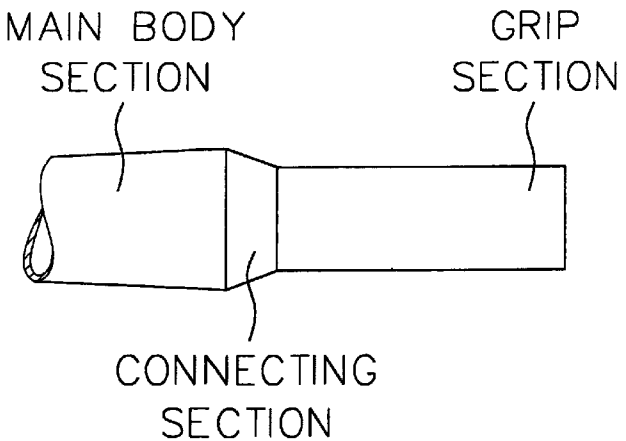
FIG. 1C PRIOR ART
FIG. 1C is a side view of a conventional "wide body" shaft.
Figure 2:
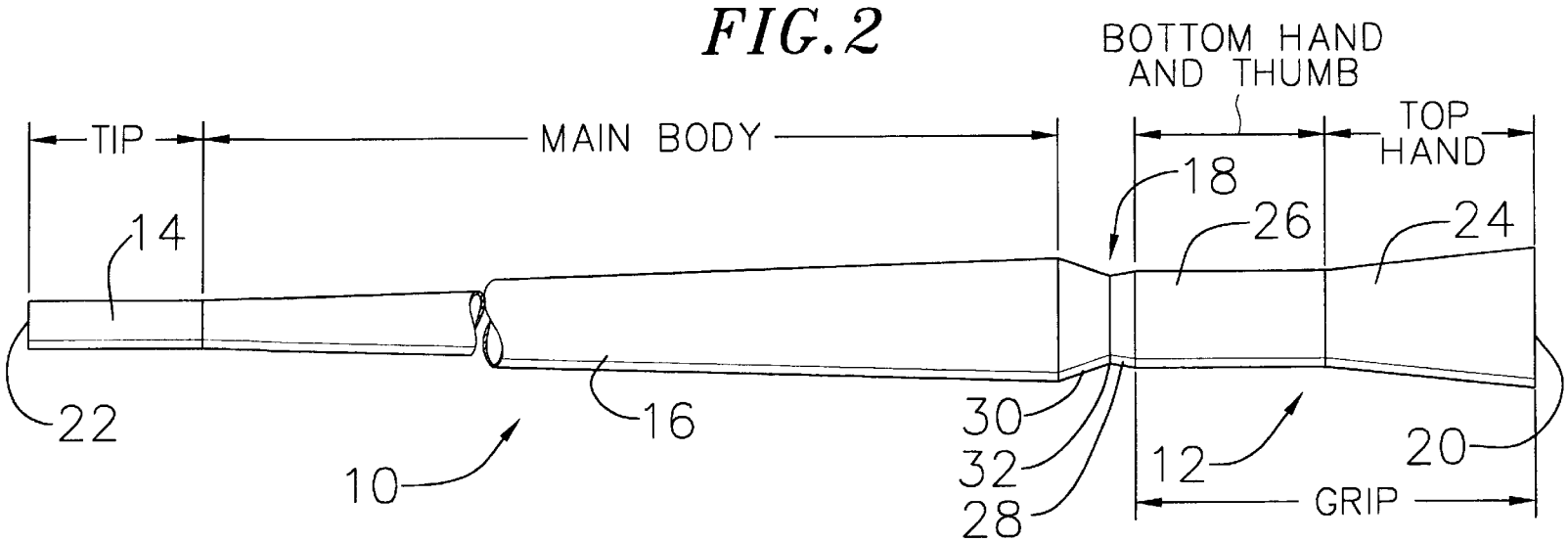
FIG. 2 is a side view of a golf club shaft in accordance with a preferred embodiment of the present invention.
Figure 3:
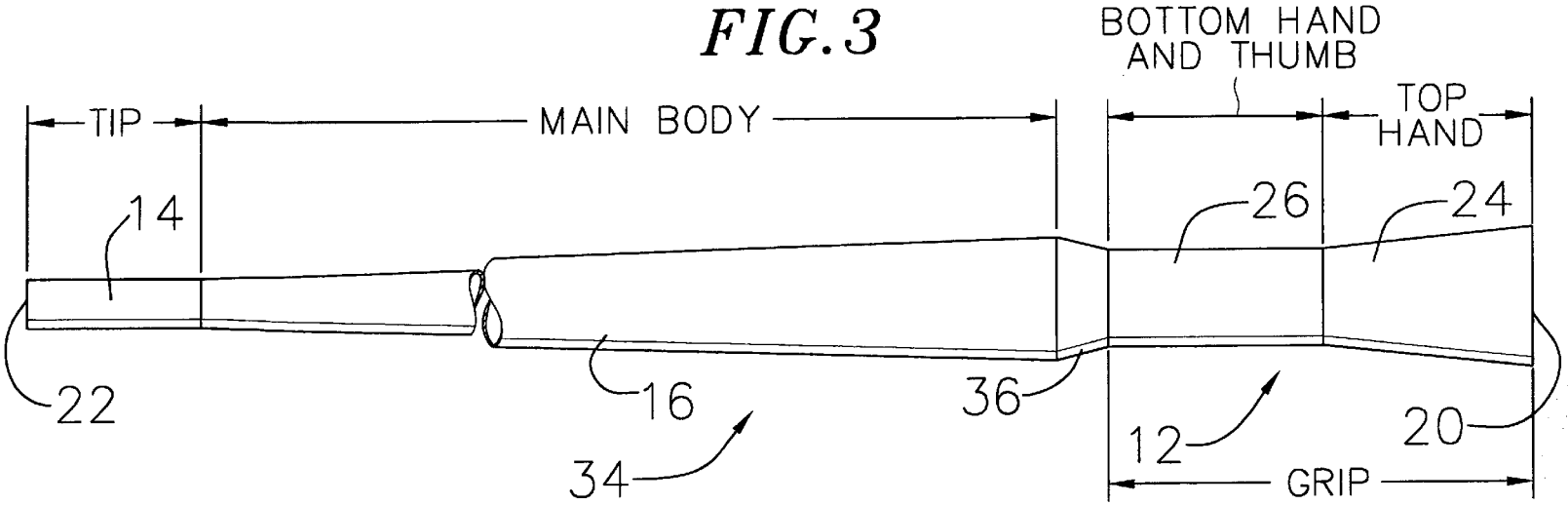
FIG. 3 is a side view of a golf club shaft in accordance with another preferred embodiment of the present invention.
Figure 4:
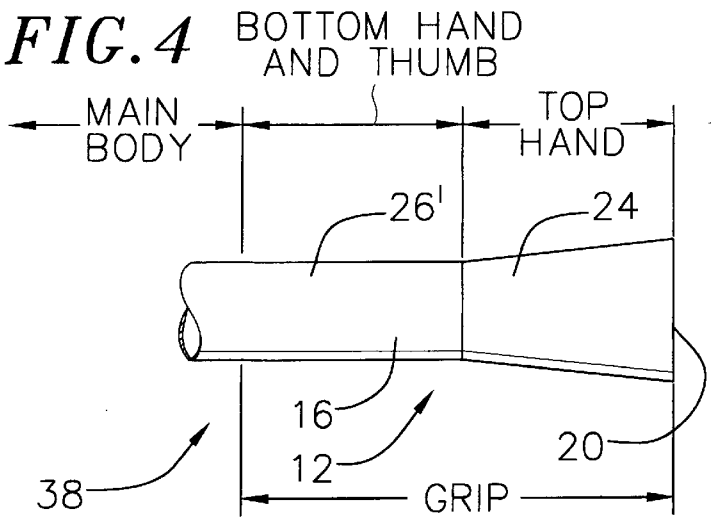
FIG. 4 is a partial side view of a golf club shaft in accordance with still another preferred embodiment of the present invention.

The grip section 12 may be incorporated into a variety of shafts in addition to the exemplary shaft shown in FIG. 2. For example, the exemplary golf club shaft 34 shown in FIG. 3 is substantially similar to the shaft shown in FIG. 2. In the shaft shown in FIG. 3, however, there is no kick section. A frusto-conically shaped outwardly tapered section 36 connects the bottom hand/bottom thumb portion 26 of the grip section to the main body section 16. Other aspects of the shafts being equal, the exemplary shaft shown in FIG. 2 will be more flexible than the exemplary shaft shown in FIG. 3. Another exemplary shaft incorporating grip section 12 is illustrated in FIG. 4. The exemplary shaft 38 shown in FIG. 4 will be more flexible than that shown in FIG. 3 because the OD of the proximal end of the main body section is reduced. The grip section 12 of shaft 38 includes a bottom hand/bottom thumb portion 26' which has a slight taper (the OD decreases at a rate of about 0.006 to about 0.009 inch/inch of shaft length). The taper corresponds to that of the main body section 16. Thus, the taper of the shaft 38 is substantially constant from the tip section to the distal end of top hand portion 24 of the grip section. The slope of this taper is, of course, far less than the slope of the respective tapers of the conventional grip portions shown in FIGS. 1A and 1B. Thus, although there is slight change in grip as a golfer chokes up on the shaft shown in FIG. 4, such a shaft nevertheless an improvement over conventional shafts, especially with respect to the contour of the grip section.

Figure 5:
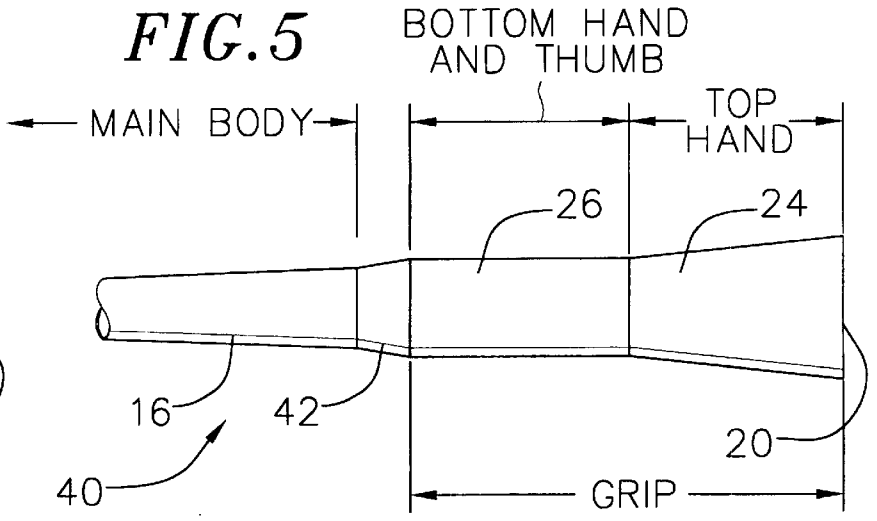
FIG. 5 is a partial side view of a golf club shaft in accordance with yet another preferred embodiment of the present invention.

Turning to FIG. 5, shaft stiffness may be further reduced by reducing the OD of the main body section 16 to such an extent that the OD of the proximal end thereof is less than that of the distal end of the bottom hand/bottom thumb section 26, as is the case in exemplary shaft 40. Here, an inwardly tapered section 42 connects the bottom hand/bottom thumb portion 26 of the grip section to the main body section 16.

Figure 6:
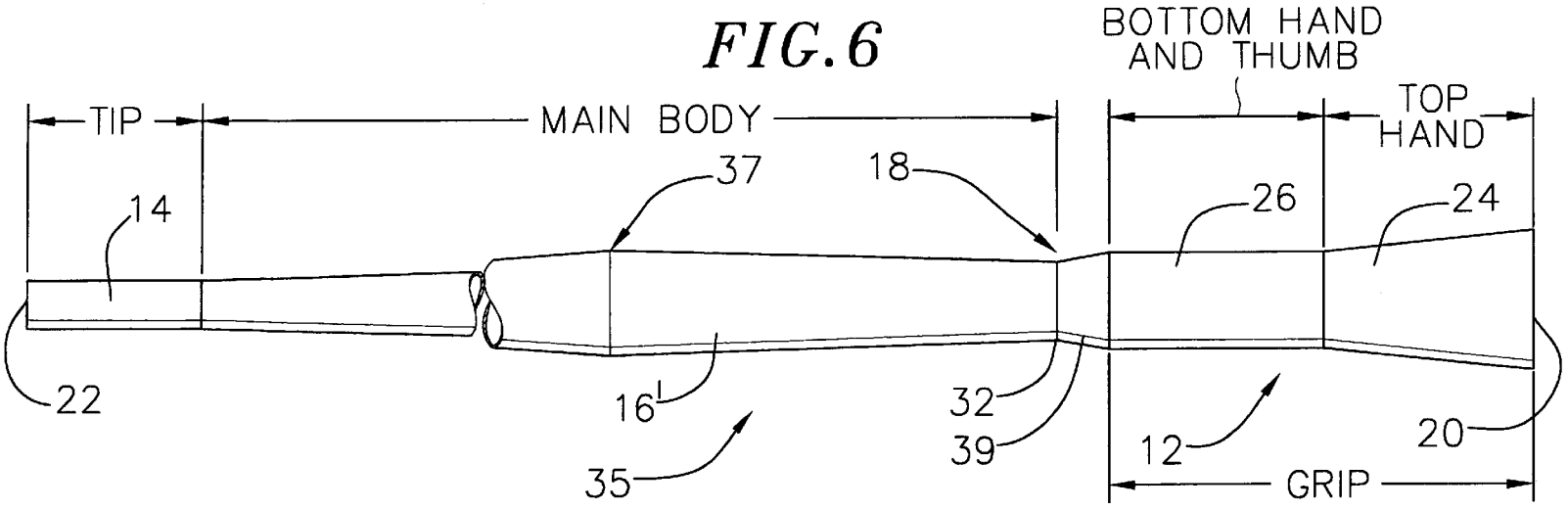
FIG. 6 is a side view of a golf club shaft in accordance with still another preferred embodiment of the present invention.

The grip section 12 shown in FIG. 2 may be incorporated into a shaft having a main body section which is configured such that the point of largest main body section OD is substantially spaced from the grip section. Referring more specifically to the exemplary shaft 35 shown in FIG. 6, the main body section 16' is configured such that the point of maximum OD 37 is at least about 1 inch from the kick section 18. The shaft is also provided with a frusto-conically shaped proximal connecting portion 39. Such a configuration further increases the flexibility of the shaft near the grip section 12.

Figure 7:
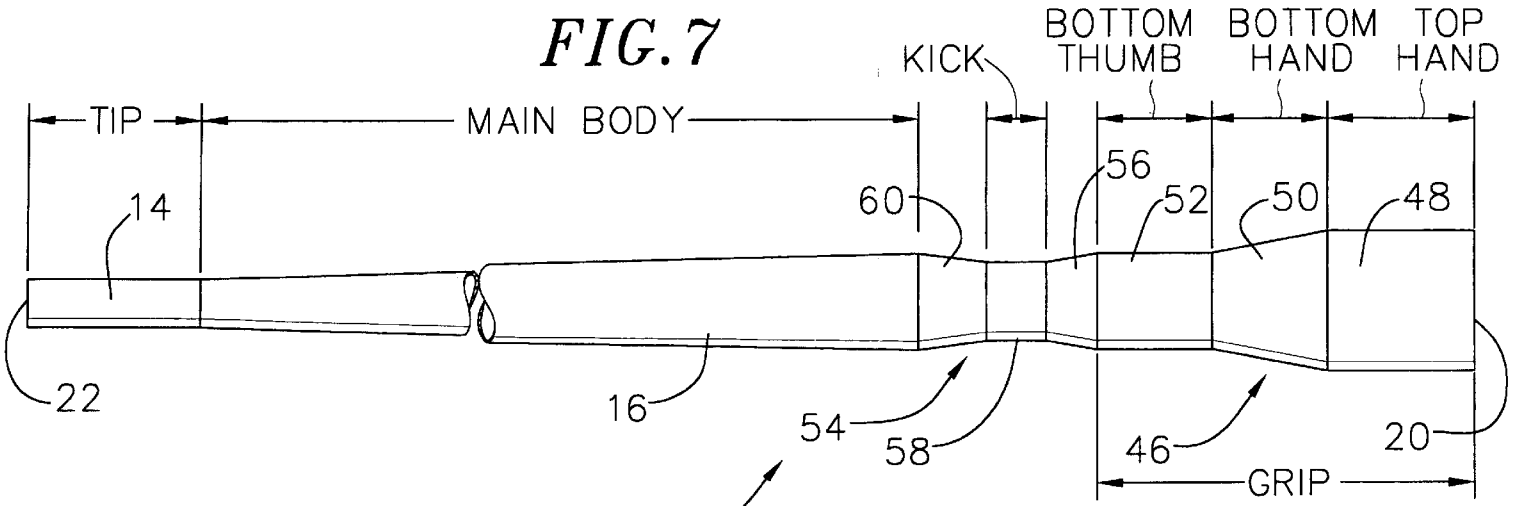
FIG. 7 is a side view of a golf club shaft in accordance with another preferred embodiment of the present invention.

In order to more closely conform to the contour of the golfer's hands, the exemplary shaft 44 shown in FIG. 7 includes a slightly different grip section than the grip section discussed above with reference to FIGS. 2–6. More specifically, exemplary shaft 44 includes a grip section 46 which consists of a substantially cylindrical top hand portion 48, a frusto-conically shaped tapered bottom hand portion 50, and a substantially cylindrical bottom thumb portion 52. The use of a grip having uniform thickness is also preferred here. The exemplary shaft 44 shown in FIG. 7 also includes a kick section 54. Here, the kick section consists of an elongate substantially cylindrical portion 58. The kick section is connected to the grip section 46 and main body section 16 by a frusto-conically shaped connecting portion 56 and a frusto-conically shaped connecting tapered portion 60. Like the exemplary kick section 18 illustrated in FIG. 2, exemplary kick section 54 creates an area of reduced OD near the grip section. The kick section 54 defines an OD that is less than the OD of the distal portion of the grip section 46 and that is also less than the largest OD of the main body section 16. This area is more flexible than the grip section and the proximal portion of the main body section. The kick section 54 shown in FIG. 7 is also longer (and, therefore, more flexible given the same OD) than the kick section 18 shown in FIG. 2.

Figure 8:
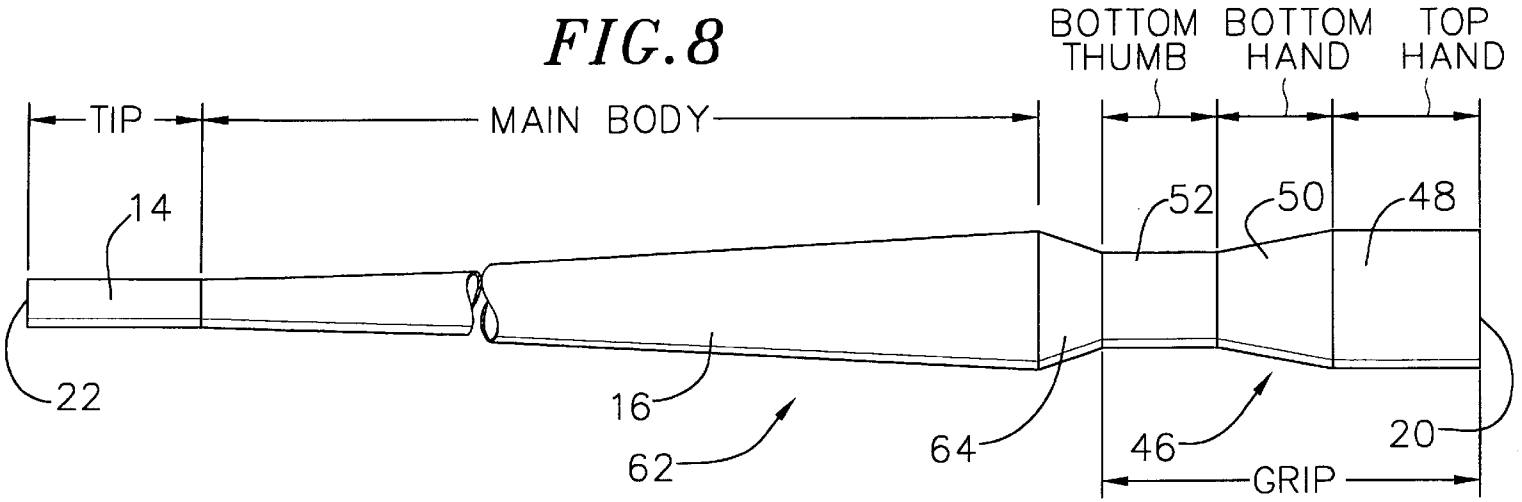
FIG. 8 is a side view of a golf club shaft in accordance with still another preferred embodiment of the present invention.

The grip section 46 shown in FIG. 7 may also be incorporated into a variety of golf club shafts that do not include a kick section. As illustrated for example in FIG. 8, exemplary shaft 62 includes a frusto-conically shaped outwardly tapered section 64 which connects the bottom thumb portion 52 of the grip section to the main body section 16. As discussed above with reference to FIG. 3, such a shaft will be relatively stiff. Another exemplary shaft incorporating the grip section 46 is illustrated in FIG. 9 and is generally indicated by reference numeral 66. Other factors being equal, the exemplary shaft 66 shown in FIG. 9 will be more flexible than the shaft shown in FIG. 8 because the OD of the main body section has been reduced. The grip section 46 of shaft 66 includes a bottom thumb portion 52' which has a slight taper. The taper corresponds to the taper of the main body section 16, thereby making the taper of exemplary shaft 66 substantially constant from the distal end of the bottom hand portion 50 to the tip section. The slope of the taper is, of course, far less than the slope of the taper of the conventional grip portions shown in FIGS. 1A and 1B.

Referring to FIG. 10, and as discussed above with reference to FIG. 5, shaft stiffness may be further reduced by decreasing the OD of the main body section 16 to such an extent that the OD of the proximal end thereof is less than that of the distal end of the bottom thumb portion 52, as is the case in exemplary shaft 68. The bottom thumb portion 52 of the grip section is connected to the main body section 16 by a frusto-conically shaped inwardly tapered section 70.

As illustrated for example in FIG. 11, the grip section 46 shown in FIG. 7 may be incorporated into a shaft having a main body section which is configured such that the point of largest main body section OD is substantially spaced from the grip section. More specifically, and as discussed above with reference to FIG. 6, the main body section 16' is configured such that the point of maximum OD 37 is at least about 1 inch from the kick section 54. Such a configuration further increases the flexibility of the shaft near the grip section 46.

Figures 13A, 13B:
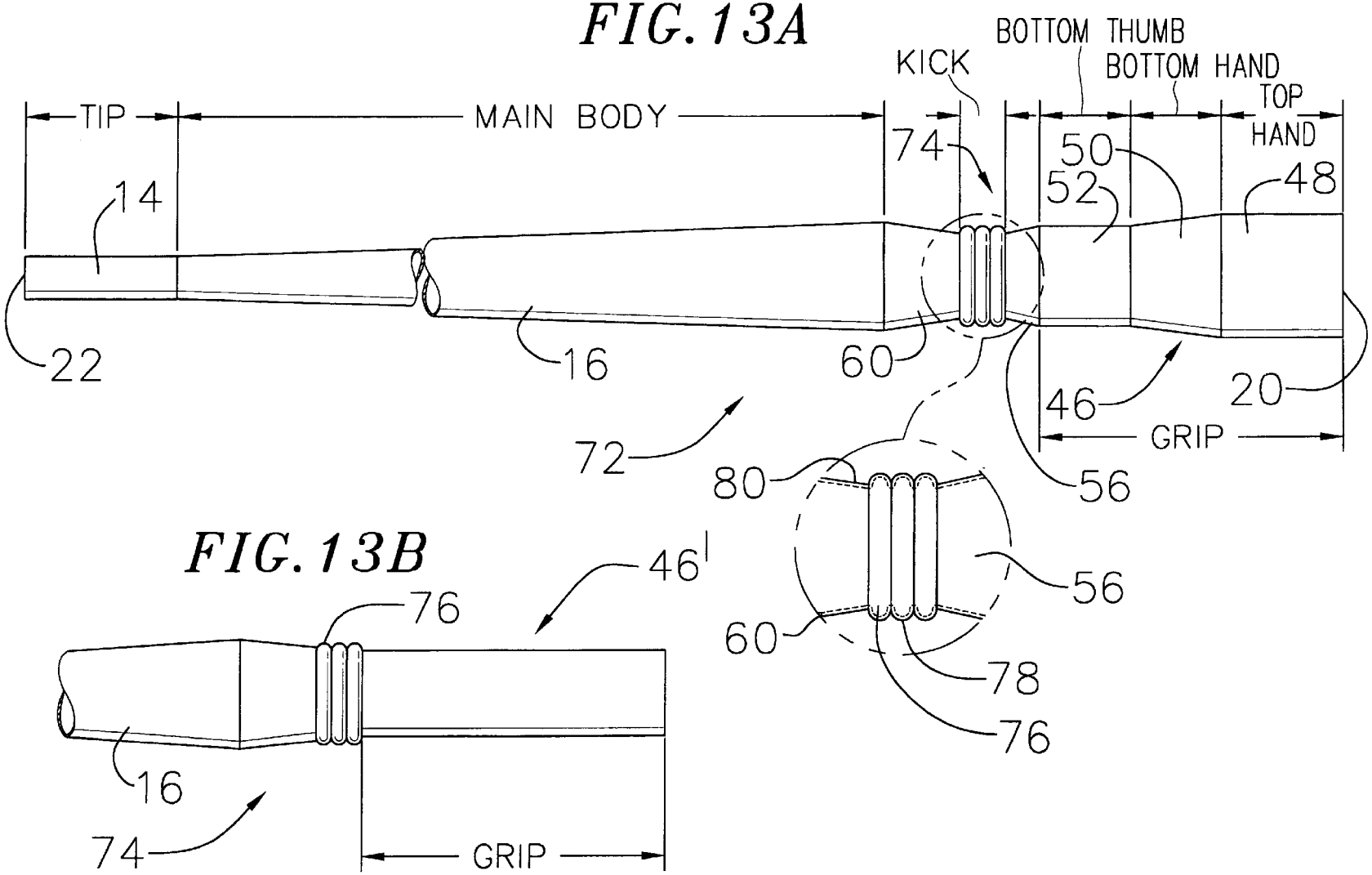
FIG. 13A is a side view of a golf club shaft in accordance with another preferred embodiment of the present invention.
FIG. 13B is a partial side view of a golf club shaft in accordance still with another preferred embodiment of the present invention.

Turning to the exemplary shaft 72 shown in FIG. 13A, the kick section 54 shown in FIG. 7, which includes the elongate substantially cylindrical portion 58, may be replaced with a kick section 74 that includes a plurality of ring-like protrusions 76. Each of the ring-like protrusions includes an area of larger OD 78 and two areas of smaller OD 80. The respective ODs of the smaller areas 80 of a given protrusion 76 may be the same as one another or different than one another. There can also be variations from protrusion to protrusion. The respective ODs of the areas of larger OD 78 may be the same, or vary from protrusion to protrusion. The lengths of the respective protrusions may also be the same or vary from protrusion to protrusion. In the preferred embodiment, the middle protrusion is slightly shorter than the other two. The shape of the interior portion of the shaft will substantially correspond to the shape of the exterior in the area of the protrusions 76. In other words, there will be a protruding surface on the interior when there is a protruding surface on the exterior and the thickness of the kick section will be substantially uniform over the length thereof. Additionally, the protrusions 76 may be positioned end to end, as shown, or there may be spacing therebetween. The protrusions may also be rounded, as shown, or have generally flat sides. The number of protrusions may vary from, for example, one to sixteen.

The protrusions 76 may be used to selectively increase or decrease the flexibility of the shaft in the vicinity of the grip section 46, as compared to the shaft shown in FIG. 7. For example, all other variables being equal, if the OD of the larger areas 78 is less than the OD of the cylindrical portion 58, then the shaft shown in FIG. 13A will be more flexible in the vicinity of grip section than the shaft shown in FIG. 7. Conversely, if the OD of the larger areas 78 is greater than that of the cylindrical portion 58, then the shaft shown in FIG. 13A will be less flexible in the vicinity of grip section than the shaft shown in FIG. 7.

The protrusions 76 also mask certain vibrations that are transmitted through the shaft when the golfer strikes a golf ball. More specifically, the protrusions create harmonic vibrations which substantially cancel the first, second and third (and so on) harmonic vibrations. This eliminates the "noise" created by the first harmonic, second harmonic, third harmonic and so on. In other words, the protrusions provide a "noise" filter which gives the golfer clearer feedback from his or her shot. The protrusions also perform this function without substantially effecting the fundamental mode vibrations so that the feel of the club is preserved.

The kick section 74 may, of course, be used in conjunction with a variety of shafts. For example, the kick section 74 may be used in conjunction with a shaft having a cylindrical grip section 46' (FIG. 13B) or a grip section having a substantially constant taper over the length thereof.

As shown by way of example in FIG. 14, exemplary shaft 82 includes a plurality of ring-like protrusions 76 which may be used to increase or decrease the flexibility of the shaft in the vicinity of the tip section 14. The protrusions form a kick section 84. The kick section 84 may be used in combination with a shaft having a kick section near the grip section, as shown, or may be used in combination with any of the other shafts illustrated herein and with conventional shafts.

Figure 16:
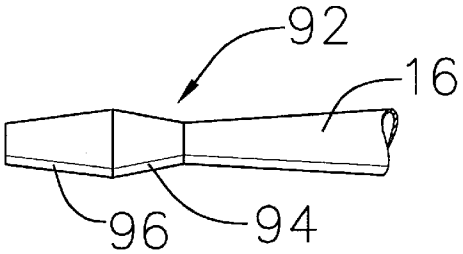
FIG. 16 is a side view of another golf club shaft tip section that may be used in conjunction with the golf club shafts shown in FIGS. 2–14.
Figure 15:
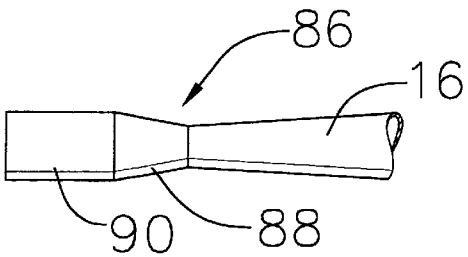
FIG. 15 is a side view of a golf club shaft tip section that may be used in conjunction with the golf club shafts shown in FIGS. 2–14.

The exemplary shafts discussed above with respect to FIGS. 2–14 may include the generally cylindrical tip section 14 shown in FIGS. 2, 3, 6, 7, 8 and 11–14. Alternatively, and as illustrated for example in FIG. 15, an exemplary tip section 86 may be provided which includes a frusto-conically shaped outwardly tapered portion 88 and a substantially cylindrical portion 90. Turning to FIG. 16, an exemplary tip section 92 includes the frusto-conically shaped outwardly tapered portion 94 and a frusto-conically shaped inwardly tapered portion 96. Another alternative is to simply make the tip section a continuation of the main body section with the same taper as the main body section.

Commercial embodiments of shafts in accordance with the present invention may be configured as follows. The overall length of the shafts may range from about 35 inches to about 46 inches. The length of the main body section preferably ranges from about 22 inches to about 33 inches. The OD of the distal end of the main body section is preferably between about 0.37 inch and about 0.50 inch for irons and between about 0.335 and about 0.50 inch for woods. The OD of the proximal end of the main body section may range from about 0.55 inch (FIGS. 5, 6, 10 and 11) to about 0.65 inch (FIGS. 2, 3, 7 and 8). With respect to the tip section, the overall length is preferably between about 4 inches and about 6 inches. The OD of the tip section shown in FIGS. 2, 3, 6, 7, 8 and 11 is preferably between about 0.37 inch and about 0.50 inch for irons and between about 0.335 and about 0.50 inch for woods. The OD of the butt end 20 of shaft preferably ranges from about 0.81 inch to about 1.0 inch.

Where the tip section includes two portions, as shown by way of example in FIGS. 12 and 13, the length of portion 74 preferably ranges from about 1 inch to about 2 inches, while the length of portions 76 and 80 is preferably between about 3 inches and about 4 inches. The OD of tapered portion 74 tapers from an OD of between about 0.300 inch and about 0.465 inch to an OD of between about 0.335 inch and about 0.500 inch for woods, and from between about 0.330 inch and about 0.500 inch to between about 0.360 inch and about 0.530 inch for irons. The OD of cylindrical portion 76 is, therefore, between about 0.335 inch and about 0.500 inch for woods, and between about 0.360 inch and about 0.530 inch for irons. The OD of tapered portion 80 tapers from an OD of between about 0.300 inch and about 0.465 inch to an OD of between about 0.335 inch and about 0.500 inch for woods, and from between about 0.330 inch and about 0.500 inch to between about 0.360 inch to about 0.530 inch for irons.

Referring more specifically to the exemplary embodiments illustrated in FIGS. 2–6, the top hand portion 26 is preferably between about 4 inches and about 6 inches, while the bottom hand/bottom thumb portion 26 is preferably between about 4 inches and about 5 inches. The OD of the bottom hand/bottom thumb section 26 is preferably between about 0.58 inch and about 0.69 inch. The OD of the kick section 18 (FIG. 2), which is essentially a kick point, is preferably between about 0.55 inch and about 0.65 inch. The combined length of the connecting portions 28 and 30 is preferably between about 1 inch.

Turning to the exemplary embodiments illustrated in FIGS. 7–11, the top hand portion is preferably between about 3 inches and about 6 inches in length, the bottom hand portion is preferably about 3 inches in length, and the bottom thumb portion is preferably between about 2 inches and about 3 inches in length. The OD of the bottom thumb portion 52 is preferably between about 0.58 inch and about 0.69 inch. The length of the kick section 54, which consists of the cylindrical portion 58 in this embodiment, is preferably between about 0.5 inch and about 2 inches, while the OD of the kick section is preferably between about 0.55 inch and about 0.65 inch. The combined length of the connecting portions 56 and 60 is preferably between about 0.5 inch and about 1 inch.

Turning to the wall thickness of the commercial embodiments, the wall thickness of the tip section is preferably between about 0.061 inch to about 0.089 inch. The thickness of the main body section preferably decreases at a constant rate from the tip section to a thickness of between about 0.028 inch and about 0.039 inch at the proximal end of the main body section. The thickness of the kick section varies from between about 0.028 inch and about 0.044 inch. The thickness of the grip section is between about 0.028 inch and about 0.044 at the distal end and is between about 0.028 inch and 0.039 inch at the proximal (or butt) end of the shaft.

With respect to the embodiments illustrated in FIGS. 13 and 14, the height of the protrusions (from the area of smaller OD to the area of larger OD) is between about 0.04 inch and about 0.15 inch. In other words, the difference in OD is between about 0.08 inch and about 0.30 inch. The length of the protrusions (from the area of smaller OD to the next area of smaller OD) is between about 0.25 inch and about 0.75 inch. Overall, the length of a kick section is preferably between about 0.5 inch and about 4.0 inches. Turning to the location of the kick section 84, the distal end of the kick section is preferably at least about 3.0 inches from the tip end 22, while the proximal end should preferably be no more than 17.0 inches from the tip end.

The present invention may be practiced with any of the materials typically used to produce composite resin/fiber golf club shafts. Suitable resins include, for example, thermosetting resins or polymers such as polyesters, epoxies, phenolics, melamines, silicones, polimides, polyurethanes, or other thermoplastics. Suitable fibers include, for example, carbon-based fibers such as graphite, glass fibers, aramid fibers, and extended chain polyethylene fibers. The preferred method of manufacturing is a bladder mold process. After successive layers (preferably 10–20) of fiber reinforced resin are wrapped around a bladder, a heated mold is placed over the wrapped bladder. The bladder is then expanded to force the material against the mold. The shaft is then cured in the mold. Curing times and temperatures depend on the polymer used in the composite and are well known to those of skill in the art. Alternatively, the present shaft may be manufactured by wrapping successive layers of fiber reinforced resin around a suitably shaped mandrel and then curing the shaft in an oven.

With respect to the layer wrapping employed in either process, the fibers of each successive layer are preferably oriented at different angles with respect to the longitudinal axis of the shaft. The fibers of some layers may be parallel to the longitudinal axis, while the fibers of other layers are angled from 30–90 degrees with respect to the longitudinal axis. It should be noted, however, that the fibers of successive layers, such as the outer layers, may be parallel to one another. Other layer combinations are also possible. For example, the first 5 to 10 layers may be alternating angled layers, and the next 5 to 10 layers may be parallel to the longitudinal axis.

Other manufacturing methods that may be used in conjunction with the present invention include filament winding and resin transfer molding.

It is suggested that the grips used in conjunction with the present shafts be thin (e.g. less than 3 mm thick) and flexible enough to conform to the shape of the shaft grip sections. Suitable grip materials include rubber and synthetic rubber. Such grips can be either tubular, or formed in a strip that is wrapped around the grip section in a manner similar to a tennis racket grip.

Although the present invention has been described in terms of the preferred embodiment above, numerous modifications and/or additions to the above-described preferred embodiments would be readily apparent to one skilled in the art. It is intended that the scope of the present invention extends to all such modifications and/or additions and that the scope of the present invention is limited solely by the claims set forth below.

I claim:

1. A golf club shaft, comprising:

a main body section defining a distal end and a proximal end;

a grip section associated with the proximal end of the main body section, the grip section including a top hand portion, a bottom hand portion and a substantially cylindrical bottom thumb portion, the top hand portion being one of substantially cylindrical and tapered and the bottom hand portion being the other of substantially cylindrical and tapered, the top and bottom hand portions each being at least one inch in length, and the tapered portion having a substantially continuous taper;

a tip section associated with the distal end of the main body section; and a kick section located between the tip section and the grip section.

2. A golf club shaft as claimed in claim 1, wherein the bottom hand portion of the grip section is substantially cylindrical and the top hand portion of the grip section is tapered.

3. A golf club shaft as claimed in claim 1, wherein the top hand portion of the grip section is substantially cylindrical and the bottom hand portion of the grip section is tapered.

4. A golf club shaft as claimed in claim 1, wherein the kick section comprises a plurality of protrusions.

5. A golf club shaft as claimed in claim 4, wherein the kick section defines an inner surface and an outer surface and the protrusions are formed in the inner and outer surfaces.

6. A golf club shaft as claimed in claim 4, wherein the protrusions are adjacent to one another.

7. A golf club shaft as claimed in claim 4, wherein the protrusions are substantially ring-shaped.

8. A golf club shaft as claimed in claim 1, wherein the kick section is substantially adjacent to the grip section.

9. A golf club shaft as claimed in claim 1, wherein the kick section is substantially adjacent to the tip section.

10. A golf club shaft as claimed in claim 1, wherein the kick section comprises first and second kick sections respectively located substantially adjacent to the tip section and to the grip section.

11. A golf club shaft, comprising:

a main body section defining a distal end and a proximal end;

a grip section associated with the proximal end of the main body section, the grip section including a top hand portion, a bottom hand portion and a substantially cylindrical bottom thumb portion, the top hand portion being one of substantially cylindrical and tapered and the bottom hand portion being the other of substantially cylindrical and tapered;

a tip section associated with the distal end of the main body section; and a kick section located between the tip section and the grip section;

wherein the grip section defines a distal end outer diameter, the main body section defines a largest main body section outer diameter, the kick section defines a smallest kick section outer diameter, and the smallest outer diameter of the kick section is less than the grip section distal end outer diameter and the largest main body section outer diameter.

12. A golf club shaft, comprising:

a main body section defining a distal end and a proximal end;

a grip section associated with the proximal end of the main body section, the grip section including a top hand portion, a bottom hand portion and a substantially cylindrical bottom thumb portion, the top hand portion being one of substantially cylindrical and tapered and the bottom hand portion being the other of substantially cylindrical and tapered;

a tip section associated with the distal end of the main body section; and a kick section located between the tip section and the grip section comprising a plurality of protrusions and defining a substantially constant wall thickness over the length thereof.

13. A golf club shaft, comprising:

a main body section defining a distal end and a proximal end;

a grip section associated with the proximal end of the main body section, the grip section including a top hand portion, a bottom hand portion and a substantially cylindrical bottom thumb portion, the top hand portion being one of substantially cylindrical and tapered and the bottom hand portion being the other of substantially cylindrical and tapered;

a tip section associated with the distal end of the main body section;

a kick section located between the tip section and the grip section; and a first tapered portion which connects the distal end of the grip section to the kick section and a second tapered portion which connects the proximal end of the main body section to the kick section.

14. A golf club shaft, comprising:

a main body section defining a distal end and a proximal end;

a grip section associated with the proximal end of the main body section;

a tip section associated with the distal end of the main body section; and a flex control section located between the tip section and the grip section defining an inner surface and an outer surface and including a plurality of protrusions formed in the inner and outer surfaces.

15. A golf club shaft as claimed in claim 14, wherein the protrusions are adjacent to one another.

16. A golf club shaft as claimed in claim 14, wherein the protrusions are substantially ring-shaped.

17. A golf club shaft, comprising:

a main body section defining a distal end and a proximal end;

a grip section associated with the proximal end of the main body section;

a tip section associated with the distal end of the main body section; and a flex control section located between the tip section and the grip section comprising a plurality of protrusions and defining a substantially constant wall thickness over the length thereof.

18. A golf club shaft, comprising:

a main body section defining a distal end and a proximal end;

a grip section associated with the proximal end of the main body section;

a tip section associated with the distal end of the main body section; and a flex control section, defining an inner surface and an outer surface, including at least one ring-shaped protrusion formed in the inner surface and at least one ring shaped protrusion formed in the outer surface.

19. A golf club shaft as claimed in claim 18, wherein the protrusions are adjacent to one another.

20. A golf club shaft as claimed in claim 18, wherein the flex control section includes a plurality of protrusions on the inner surface and a plurality of protrusions on the outer surface.

21. A golf club shaft as claimed in claim 18, wherein the ring-shaped protrusion defines a curved outer surface.

22. A golf club shaft, comprising:

a main body section defining a distal end and a proximal end;

a grip section associated with the proximal end of the main body section;

a tip section associated with the distal end of the main body section; and a flex control section, defining and inner surface, an outer surface and a substantially constant wall thickness over the length thereof, including at least one ring-shaped protrusion formed in the inner surface and at least one ring shaped protrusion formed in the outer surface.

23. A golf club shaft, comprising:

a main body section defining a distal end and a proximal end;

a grip section associated with the proximal end of the main body section, the grip section including a tapered top hand portion having a proximal end defining the proximal end of the grip section, a cylindrical bottom hand portion and a substantially cylindrical bottom thumb portion;

a tip section associated with the distal end of the main body section; and a kick section located between the tip section and the grip section.

* * * * *